US007882969B2

(12) United States Patent
Gerstner et al.

(10) Patent No.: US 7,882,969 B2
(45) Date of Patent: Feb. 8, 2011

(54) DISPLAY SYSTEM WITH ADJUSTABLE PRODUCT HOLDER TRACK

(75) Inventors: Robert Gerstner, Sleepy Hollow, NJ (US); R. Christopher Kidd, New York, NY (US)

(73) Assignee: Lloyd, Gerstner & Partners, Paramus, NJ (US)

( * ) Notice: Subject to any disclaimer, the term of this patent is extended or adjusted under 35 U.S.C. 154(b) by 299 days.

(21) Appl. No.: 11/893,685

(22) Filed: Aug. 16, 2007

(65) Prior Publication Data

US 2009/0045707 A1 Feb. 19, 2009

(51) Int. Cl.
*A47G 29/087* (2006.01)

(52) U.S. Cl. ..... 211/119.003; 211/94.01; 211/43

(58) Field of Classification Search ..... 211/59.2, 211/187, 190, 191, 119.003, 85.26, 85.31, 211/88.01, 126.1, 133.6, 126.15, 175, 43, 211/184, 208; 40/661.03, 490, 611.08, 739, 40/741; 248/448, 346.06, 346.07, 223.41, 248/244

See application file for complete search history.

(56) References Cited

U.S. PATENT DOCUMENTS 723,497 A * 3/1903 Strauss ..... 40/741
1,524,793 A * 2/1925 Lemery ..... 40/741
1,767,726 A * 6/1930 Woerz ..... 40/618
2,016,942 A * 10/1935 Horwitt et al. ..... 40/739
4,698,928 A * 10/1987 Soporowski ..... 40/651
4,835,889 A * 6/1989 McClymonds ..... 40/606.09
5,881,484 A * 3/1999 Carroll ..... 40/649
6,076,295 A * 6/2000 Garfinkle ..... 40/605
6,226,910 B1 * 5/2001 Ireland ..... 40/661.03
6,497,329 B1 * 12/2002 Johnson et al. ..... 211/128.1
6,571,498 B1 * 6/2003 Cyrluk ..... 40/661.03
6,688,567 B2 * 2/2004 Fast et al. ..... 248/220.41
7,048,131 B2 * 5/2006 Gay et al. ..... 211/187
7,055,275 B1 * 6/2006 Teza et al. ..... 40/735

* cited by examiner

*Primary Examiner*—Darnell M Jayne
*Assistant Examiner*—Dan Rohrhoff
(74) *Attorney, Agent, or Firm*—Cohen Pontani Lieberman & Pavane LLP

(57) ABSTRACT

A display system for product stored in bins includes a first track member which can be fixed to an elongate support member, and a second track member which can be fixed to the first track member in a selected one of a plurality of relative positions to form a track having a height dimension which is dependent on the relative position selected. A plurality of product holders can be secured side-by-side in the track, the relative position of the track members being selected dependent on the height dimension of the product holders. A plurality of bins can be arranged side-by-side on shelves adjacent to the track, the elongate support member preferably being fixed to the distal end of a cantilever beam.

21 Claims, 5 Drawing Sheets

DISPLAY SYSTEM WITH ADJUSTABLE PRODUCT HOLDER TRACK

BACKGROUND OF THE INVENTION

1. Field of the Invention

The invention relates to a display system for use with product stored in bins, and to a bin system incorporating such a display system.

2. Description of the Related Art

Large retail outlets, often referred to as "big box" stores, typically store product in multi-tier racks. The upper tiers are generally used only for storage, whereas the tiers at floor level provide customer access to the product, which is kept in bins in easy reach within the rack. Product samples are displayed in front of the bins together with identifying information and price. As bins are emptied, additional product is moved into the bins from higher levels. This has proven to be a convenient system for marketing hardware, plumbing fixtures, electrical fixtures, and other products of relatively small size.

The racks typically consist of bays which are approximately 8 feet wide between uprights, and the product samples are fixed to beams or boards which are fixed across the front of the uprights. The product samples and identifying information are fixed to the beams in alignment with product in the bins behind the beam. When different size bins are substituted or the bins are rearranged, it is necessary to remount the product samples on the beam, which may require entirely rearranging the samples along the length of a beam. This is done on the premises and is very labor intensive.

SUMMARY OF THE INVENTION

An object of the invention is to provide a display system for product stored in bins in racks, wherein the arrangement of products displayed in front of the bins may be readily changed or rearranged, with a minimum of on-the-premises labor.

It is another object of the invention, to provide a bin system which incorporates the display system according to the invention.

The display system according to the invention utilizes a track which engages product holders which may be readily removed from the rack, replaced, and rearranged. The track includes a first track member which can be fixed to an elongate support member fixed to the rack, and a second track member which can be fixed to the first track member in a selected one of a plurality of relative positions to form a track having a height dimension which is dependent on the selected relative position. A plurality of product holders can be secured side-by-side in the track, the product holders having a height dimension which corresponds to the height dimension of the track. The final relative position of the track members is therefore determined the height dimension of the product holders.

The track members are designed to be slid together so that they engage the product holders and secure the product holders in the track. All product holders in a track therefore have the same height dimension, but may have different width dimensions. To draw the track members together, machine screws received through collars on the first track member engage respective nuts which are fixed against rotation in the second track member. A clockwise turning of the machine screws thereby draws the track members together to engage and secure the product holders. In order to remove a product holder, the screws are simply loosened until the track members move apart sufficiently to release the product holders. The product holders can then be rearranged or replaced as desired. While different size screws can be used for product holders having different heights, it is convenient to use screws which are long enough to accommodate the product holders having the greatest height for which the track members are designed. The screws may be turned at high speed by an electric screw driver.

In a bin system incorporating the display, the bins are supported on a shelves supported by cantilever beams inside the rack. An elongate support member, which is preferably a hollow extruded member having an angled front surface, is fixed transversely across the distal ends of the cantilever beams. The first track member is fixed to the angled front surface in any of a selected plurality of positions, in particular two different positions where first or second abutments on the track member are against respective top or bottom edges of the support member. The cantilever beams are preferably of telescoping design so that the position of the support member, and thus the product holders, may be adjusted. This position is preferably recessed from the front of the rack in order to avoid damage by forklift trucks carrying pallets.

An important advantage of the invention is that product may be fixed to the product holders remotely, for example at the point of origin of the product, so that it is only necessary to assemble the product holders to the track at point of sale.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
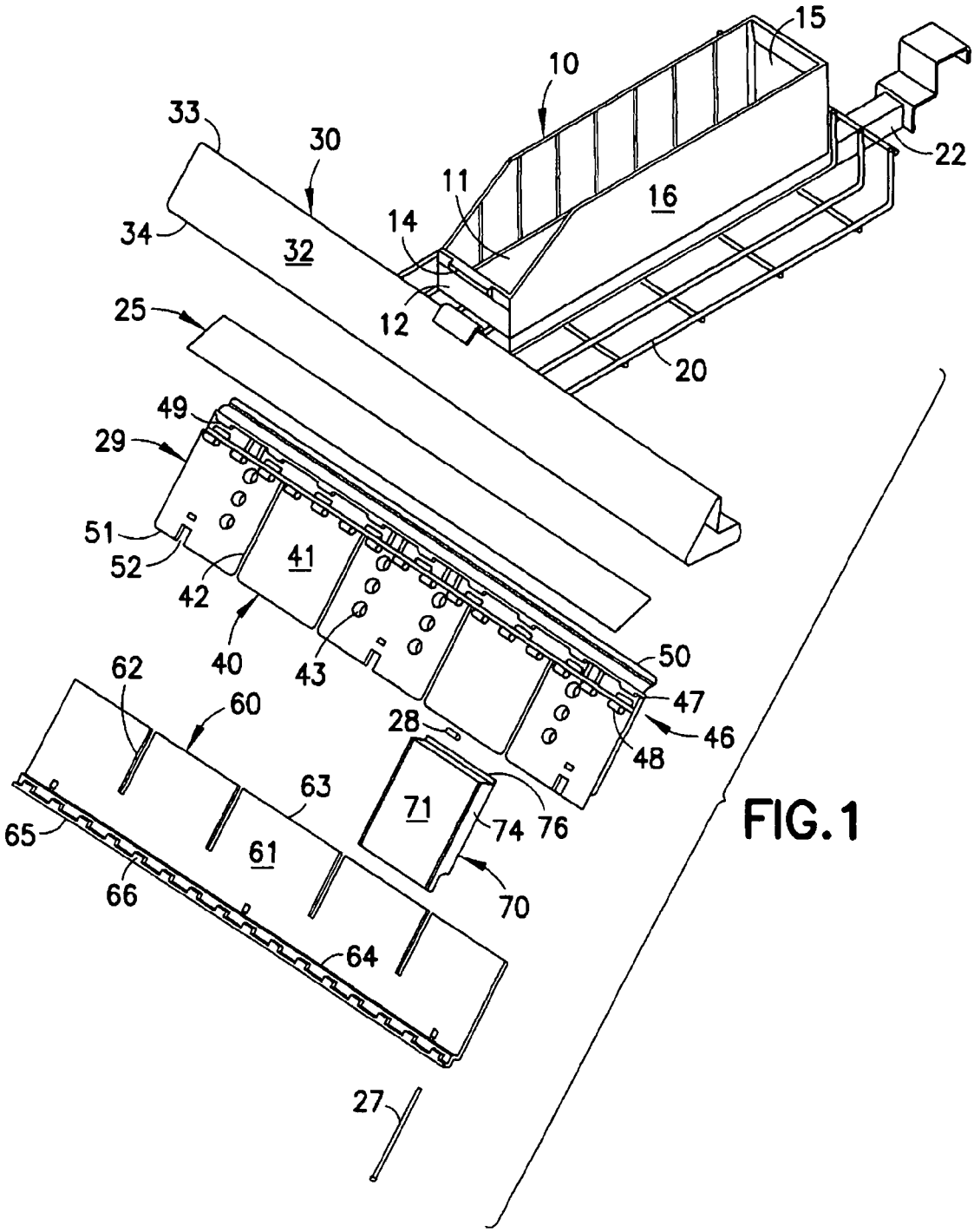
FIG. 1 is an exploded perspective view of a bin system according to the invention.
Figure 2:
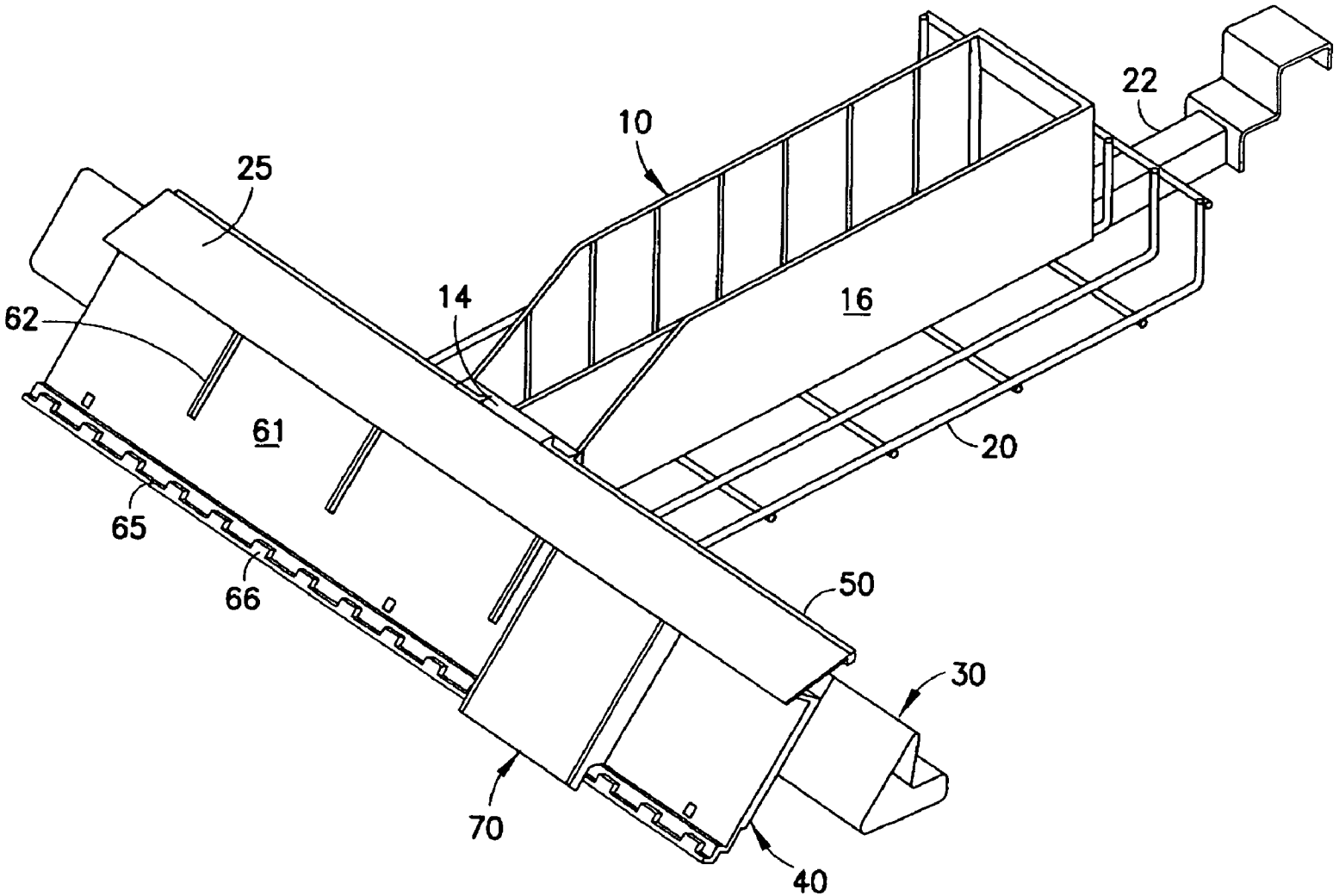
FIG. 2 is a perspective view of the assembled bin system according to the invention.

FIGS. 1 and 2 show a bin 10 supported by a shelf 20 on a cantilever beam 22. Each bin has a floor 11, a front wall 12 with a lip 14, a rear wall 15, and a pair of side walls 16. While a plurality of bins 10 can be supported side-by-side on the shelf 20, for simplicity only one bin is shown here. Likewise, a number of cantilever beams are provided, but only one is shown.

An elongate support member 30 is fixed transversely across the distal ends of beams 22 and serves as a substrate for mounting an upper track member 40, to which a lower track member 60 is fixed to form a complete track for holding a plurality of side-by-side product holders 70, of which only one is shown. The support member 30 is a hollow member having a mounting surface 32 bounded by a top edge 33 and a bottom edge 34, and a rear step 36 facing oppositely from the mounting surface 32. The upper track member 40 has a front surface 41 interrupted by slots 42, and a number of mounting insets 43 molded in the mounting surface. The front surface 41 is bounded by a top edge 46 formed by a channel 47, and a bottom edge 51 provided with notches 52. The channel 47 has outer retaining tabs 48 for engaging the product holder 70, and inner retaining tabs 49 for retaining an art panel 25. The lower track member 60 has a front surface 61 interrupted by slots 62 which enable molding of L-shaped ribs 68 (FIG. 4) which engage the slots in the upper track member 40. The front surface 61 is bounded by a top edge 63 and a bottom edge 64 bounded by a flange 65 formed with retaining tabs 66 for engaging the product holder 70. The product holder has a front surface 71 to which an item of hardware or other merchandise is attached, the item corresponding to items in the adjacent bin.

To assemble the track, the upper track member 40 is fixed to the mounting surface 32 of the support member by means of screws (not shown) which are received through holes in the bottoms of selected mounting insets 43. These screws are threaded into holes (not shown) in the mounting surface 32. In lieu of pre-positioned holes, the screws may be self-tapping so that any desired relative position of the upper track member 40 and the support member 30 may be selected. The lower track member 60 is then engaged with the upper member 40 by aligning the slots 62 with the slots 42 and moving the lower member 60 in the direction of the arrow until the track members 40, 60 engage the product holder 70. The track members are then fixed together by a plurality of machine screws 27 and square nuts 28, as will be described.

Figure 3:
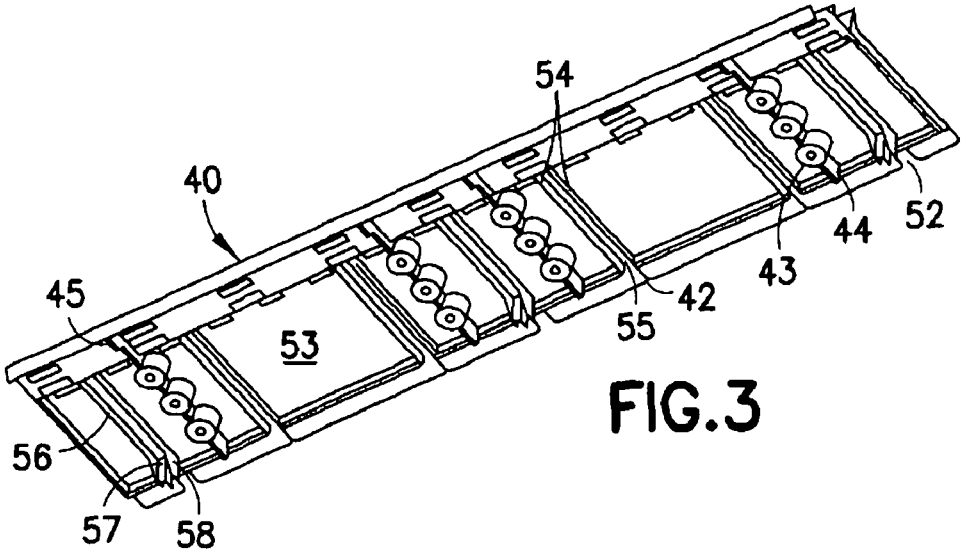
FIG. 3 is a rear perspective view of the upper track member.
Figure 4:
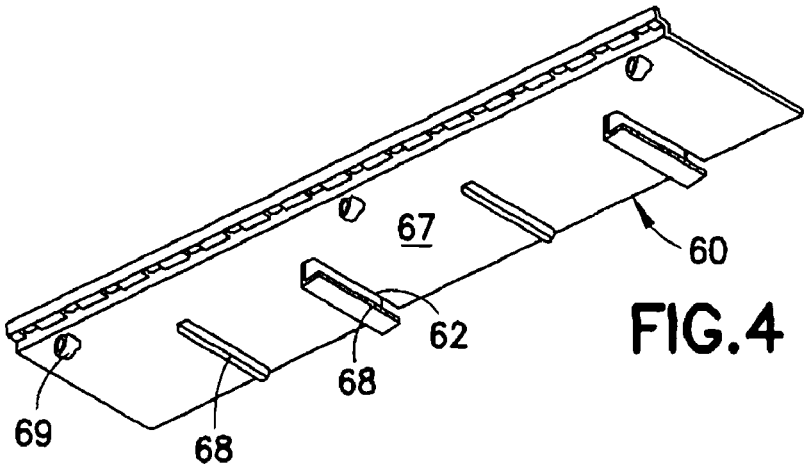
FIG. 4 is a rear perspective view of the lower track member.

Referring to FIG. 3, the upper track member 40 has a rear surface 53 provided with a pair of ribs 54 flanking each slot 42, one rib of each pair being spaced from the slot 42 to leave an intervening strip 55 of rear surface 53 which can be engaged by an L-shaped rib 68 (FIG. 4). Each row of insets 43 is aligned along a support wall 44 ending at a top ramp 45 which serve as an abutment for positioning the upper track member 40 in a first position relative to the support member 30. The rear surface 53 is also molded with upstanding reinforcing channels 56, each having an endwall 57 profiled to hold a nut 28 and flanked by a pair of bottom ramps 58 which serve as an abutment for positioning the upper track member 40 in a second position relative to the support member 30. As a machine screw 27 is threaded clockwise into a nut 28, the end of the screw is received in a channel 56.

Referring to FIG. 4, the lower track member 60 has a rear surface 67 with upstanding L-shaped ribs 68. Note that the distal edges of each pair of adjacent ribs 68 face in opposite directions so that the lower track member 60 can positively engage the slots 42 in the upper track member 40, the edges of the ribs 68 hooking over the strips 55 adjacent to slots 42 in the upper track member 40. The lower track member 60 is also provided with screw collars 69 which receive respective machine screws 27. When the track members 40, 60 engage a small (minimum height) product holder 70, screw collars 69 are received in the notches 52.

Figure 5:
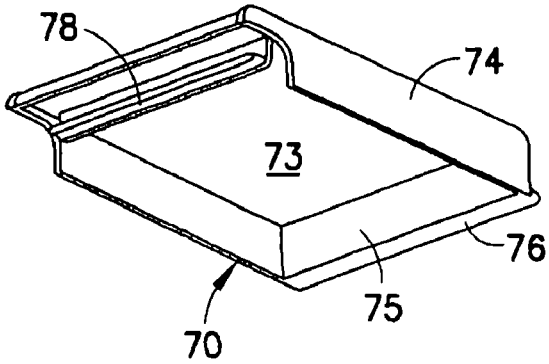
FIG. 5 is a rear perspective view of the product holder.

Referring to FIG. 5, the product holder 70 has a rear surface 73 bounded by sidewalls 74 and a top wall 75 having a top flange 76 which is engaged by retaining tabs 48 on the upper track member 40. An L-shaped bottom flange 78 is engaged by the retaining tabs 66 on the lower track member 60 when the track members 40, 60 are slid into engagement with the product holder 70. Note that it is necessary to use a cammed core piece in order to mold the flange 78.

Figure 6:
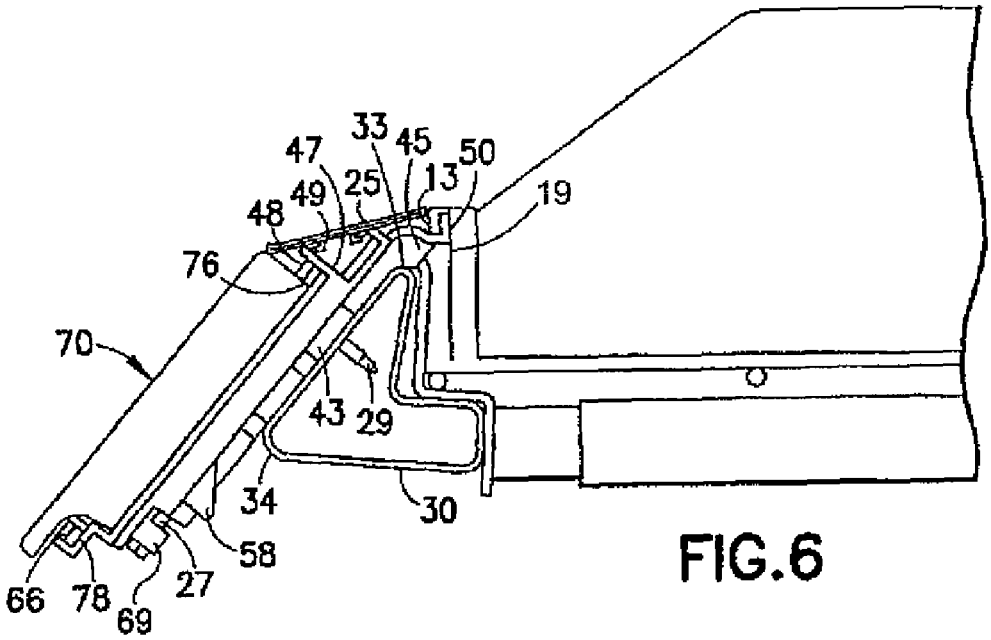
FIG. 6 is a side view of the assembled bin system in a first position, showing a bin on a support beam.

FIG. 6 is a side view of a first mounting arrangement of the bin system, wherein the upper track member 40 is fixed to the support member 30 by means of screws 29 received in the uppermost insets 43 of a column. Here the top ramps 45 rest against the top edge 33 of the support member 30 to aid in positioning. The top flange 76 of product holder 70 is received under the retaining tabs 48 on the upper track member 40, and the bottom flange 78 is received under the retaining tabs 66 on the lower track member 60. The track members are fixed together by the machine screws 27 received through the collars 69 and threaded into nuts 28 (not visible).

As can also be seen in FIG. 6, the lip 13 on the front wall 12 of the bin 10 engages the top flange 50 of the upper track member 40; a detent 19 on the front wall of the bin snaps into place under the flange 50. A so-called art panel 25 is fixed to the channel 47 by means of L-shaped ribs 26 on the panel engaging inner retaining tabs 49 in the mounting channel 47; the art panel can therefore be slid into place over the channel 47. The art panel carries identifying information for the parts attached to the product holders and contained in the bins.

Figure 7:
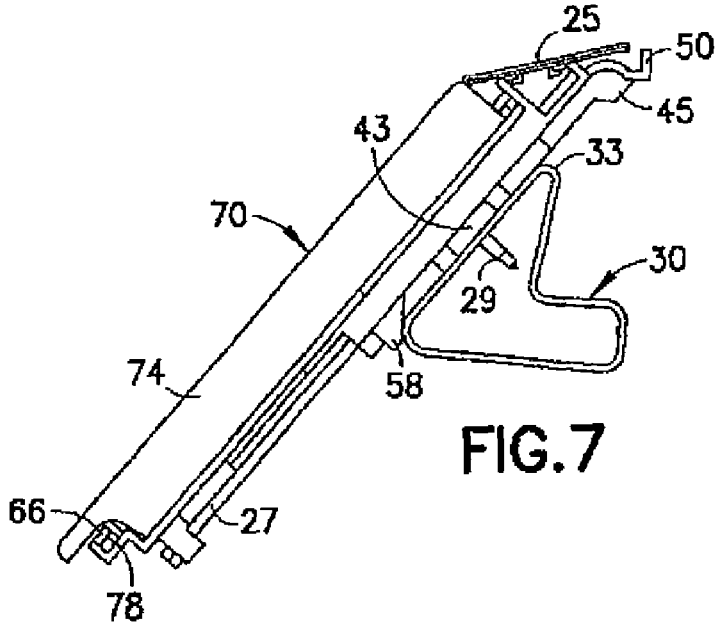
FIG. 7 is a side view of the assembled bin system in a second position, not showing the bin and support beam.

FIG. 7 is a side view of a second mounting arrangement, which differs from the mounting arrangement of FIG. 6 in two respects. First, the upper track member 40 is positioned differently with respect to the support member 30. More particularly, the bottom ramps 58 abut the bottom edge 34 of the support member, and the mounting screws 29 are received through the middle insets 43 of a column. Second, the lower track member 60 is positioned differently with respect to the upper track member 40, in order to accommodate larger product holders 70. That is, the product holder 70 of FIG. 7 has a greater height dimension than the product holder of FIG. 6. The other retaining features, i.e. the engagement of the flanges 76, 78 by the tabs 48, 66, are the same as in FIG. 6.

Figure 8:
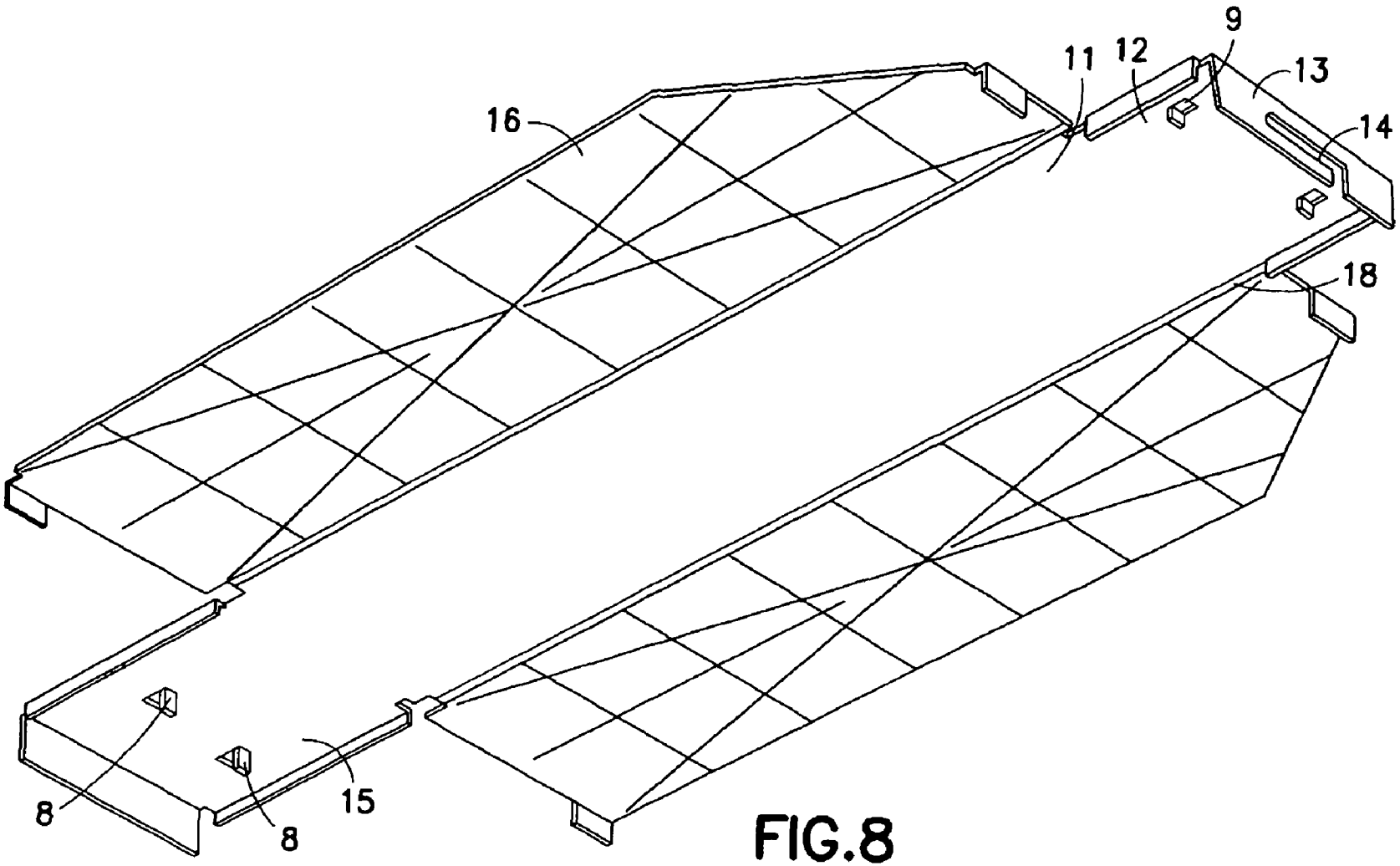
FIG. 8 is a perspective view of the bin prior to assembly.

FIG. 8 shows a preferred embodiment of the bin 10 prior to folding to form the box-like configuration of the FIGS. 1 and 2. The bin 10 includes a floor 11, a front wall 12 having a flap 13 and a lip 14, a rear wall 15, and a pair of sidewalls 16. The bin 10 is molded with grooves 18 between the walls 12, 15, 16 and the floor 11, the grooves 18 serving as hinges which permit folding the walls into orthogonal relationship with the floor. The bin includes details such as hooks and openings 8, 9 to maintain the bin in its assembled state. A groove adjacent to the flap 13 permits folding it against the inside of the front wall 12, so that the lip 14 extends outward from the bin for engaging the top track member, as shown in FIGS. 6 and 7.

Note that bins may be designed to be deeper and wider than that depicted. Also, the product holders may vary not only in height, but in width. Generally speaking, the product holders will be as wide as the bins, and are in multiples of a common base width, for example two inches. That is, the product holders and the bins are typically four, six, eight, or ten inches wide. The product holders may extend beyond the end of one track and overlap the next track, thereby aligning the tracks and thus the product holders on adjacent tracks. Since the tracks are typically 24⅝ inches wide, this overlap aligns the product holders linearly across the width of a bay.

As suggested above, the track members, the product holders, and the bins are preferably made by injection molding a thermoplastic material; (polypropylene for bins and ABS Acrylonitrile butadiene styrene) for track members and product holders are especially suitable.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A bin system comprising:

an elongate support member;

a first track member fixed to said elongate support member;

a second track member fixed to said first track member in a selected one of a plurality of relative positions to form a track having a height dimension which is dependent on the selected relative position, wherein said track members are engageable by sliding together in a direction parallel to the height dimension of the track, and wherein one of said track members has a plurality of parallel slots and the other of said track members has a plurality of parallel ribs which are profiled to engage said slots;

a plurality of bins arranged side-by-side adjacent to said track;

a plurality of product holders secured side-by-side in said track, said product holders having a height dimension which corresponds to the height dimension of the track; and a drawing member for selectively sliding said track members together and moving said track members apart;

whereby the relative position of the track members are selected based on the height dimension of the product holders.

2. The bin system of claim 1 wherein the plurality of product holders are positioned adjacent to respective said bins.

3. The bin system of claim 1 wherein at least some of said parallel ribs have an L-shaped cross-section.

4. The bin system of claim 1 wherein said track members can be slid together to secure said product holders in said track.

5. The bin system of claim 4 wherein each of said track members has engaging features which cooperate with said product holders to secure said product holders in said track.

6. The bin system of claim 5 further comprising a fixing member fixing said track members together when said product holders are secured in said track.

7. The bin system of claim 6 wherein said fixing member comprises at least one screw which is used to draw said track members into engagement with said product holders.

8. The bin system of claim 1 wherein said first track member is molded with mounting insets which can receive screws for fixing said first track member to said support member in a selected one of a plurality of relative positions.

9. The bin system of claim 1 wherein the bins are connected to the track.

10. The bin system of claim 9 wherein said first track member has a flange and each said bin has a flange which engages the flange of the first track member to connect the bins to the first track member.

11. The bin system of claim 10 wherein each said bin has at least one detent which engages the first track member in a track fit when respective said flanges are engaged.

12. A display system for product stored in bins, the system comprising:

a first track member fixed to an elongate support member;

a second track member fixed to said first track member in a selected one of a plurality of relative positions to form a track having a height dimension which is dependent on the selected relative position, wherein said track members are engageable by sliding together in a direction parallel to the height dimension of the track, and wherein one of said track members has a plurality of parallel slots and the other of said track members has a plurality of parallel ribs which are profiled to engage said slots;

a plurality of product holders secured side-by-side in said track, said product holders having a height dimension which corresponds to the height dimension of the track; and a drawing member for selectively sliding said track members together and moving said track members apart;

whereby the relative position of the track members are selected dependent on the height dimension of the product holders.

13. The display system of claim 12 wherein at least some of said parallel ribs have an L-shaped cross-section.

14. The display system of claim 12 wherein said product holders are secured in said track by sliding said track members together.

15. The display system of claim 14 wherein each of said track members has engaging features which cooperate with said product holders to secure said product holders in said track.

16. The display system of claim 14 further comprising a fixing member for fixing said track members together when said product holders are secured in said track.

17. The display system of claim 16 wherein said fixing member comprises at least one screw which is used to draw said track members into engagement with said product holders.

18. The display system of claim 12 wherein said first track member is molded with mounting insets which can receive screws for fixing said first track member to said elongate support member in a selected one of a plurality of relative positions.

19. The display system of claim 12 wherein said first track member comprises a first abutment aligned in a direction perpendicular to said height dimension, said first abutment abutting said elongate support member in a first relative position of said first track member to said support member.

20. The display system of claim 19 wherein said first track member further comprises a second abutment aligned in a direction perpendicular to said height dimension, said second abutment facing said first abutment, said second abutment abutting said elongate support member in a second relative position of said first track member to said support member.

21. The display system of claim 12 wherein the uppermost one of the first and second track members comprises a mounting channel having mutually facing tabs, the display system further comprising an art panel with L-shaped ribs which engage under said tabs by sliding the art panel over the channel.

* * * * *